United States Patent [19]

Lewis

[11] Patent Number: 5,060,314

[45] Date of Patent: Oct. 29, 1991

[54] MULTI-MISSION BALLISTIC RESISTANT JACKET

[75] Inventor: Michael L. Lewis, Panama City, Fla.

[73] Assignee: The United States of America as represented by the Secretary of the Navy, Washington, D.C.

[21] Appl. No.: 504,522

[22] Filed: Apr. 3, 1990

[51] Int. Cl.[5] ..... F41H 1/02

[52] U.S. Cl. ..... 2/2.5; 2/2; 2/94; 441/112

[58] Field of Search ..... 2/2, 2.5, 44, 45, 69, 2/92, 94, 95, 102; 441/88, 102, 106, 111, 112

[56] References Cited

U.S. PATENT DOCUMENTS

| | | | |
|---|---|---|---|
| 3,130,414 | 4/1964 | Bailey | 2/2.5 |
| 3,973,275 | 8/1976 | Blauer | 2/2.5 |
| 4,287,607 | 9/1981 | Leach | 2/2.5 |
| 4,453,271 | 6/1984 | Donzis | 2/2 |
| 4,497,069 | 2/1985 | Braunhut | 2/2.5 |
| 4,555,234 | 11/1985 | Kent | 441/112 |
| 4,590,622 | 5/1986 | Wolfe | 2/2 |
| 4,648,136 | 3/1987 | Higuchi | 2/2.5 |
| 4,658,442 | 4/1987 | Tomlinson | 2/94 |
| 4,668,202 | 5/1987 | Scheurer | 441/112 |
| 4,669,125 | 6/1987 | Allen | 2/94 |
| 4,697,285 | 10/1987 | Sylvester | 2/2.5 |
| 4,821,339 | 4/1989 | Fair | 2/44 |
| 4,879,165 | 11/1989 | Smith | 2/2.5 |

FOREIGN PATENT DOCUMENTS

| | | | |
|---|---|---|---|
| 2821718 | 11/1978 | Fed. Rep. of Germany | 2/2.5 |
| 2210773 | 6/1989 | United Kingdom | 2/2.5 |

*Primary Examiner*—Werner H. Schroeder
*Assistant Examiner*—Diana L. Biefeld

[57] ABSTRACT

An improved ballistic resistant soft body armor jacket that is fit-adjustable, relatively lightweight, multi-mission adaptable, buoyant, fire-resistant, non hydroscopic and impervious to salt water and most petroleum-based fluids. The jacket shell consists of four basic ballistic resistant components: a back panel, left and right front panels in combination with side portions, and a permanent collar. It is of wrap around character and uniquely provides a minimum of one inch overlap of the respective fabric-encased ballistic inserts at both sides and in the front. It uses hook and loop type fasteners, such as Velcro®, in combination with some elasticized fastener bands to provide essentially one handed capability of the various closure and adjustability features. It uses non-hydroscopic material, such as Spectra Shield®, for the ballistic inserts, and a fire proof fabric, such as Nomex III®, with a water repellant coating. An external chest pocket is provided for an auxiliary armor plate, while inside under arm pockets and pockets in add-on shoulder pads can accommodate flotation packets. Other quick attach-detach accessories include leg straps housed in a back pocket when not needed, a second add-on higher protective collar, secondary combined shoulder and upper arm pads, a groin pad, special purpose pockets for added ammunition and other items. The jacket is capable of withstanding multiple strikes from a 9 mm submachine gun; and with use of the auxiliary chest area pocketed armor plate can withstand certain fire power of AK47 type weapons.

26 Claims, 4 Drawing Sheets

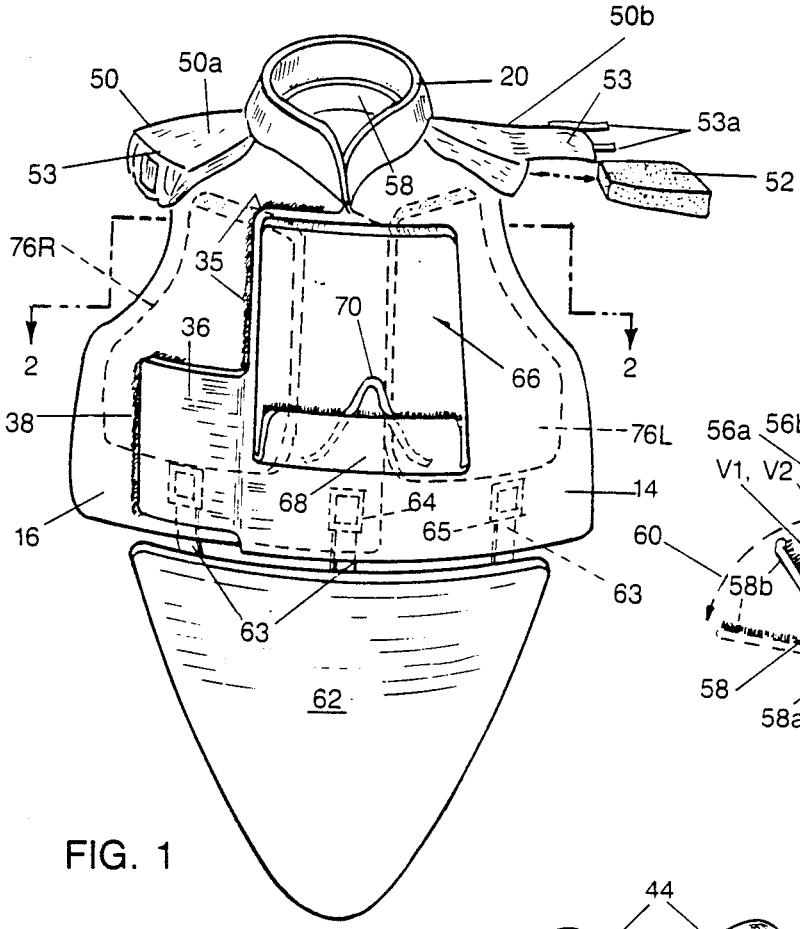
FIG. 1
FIG. 6
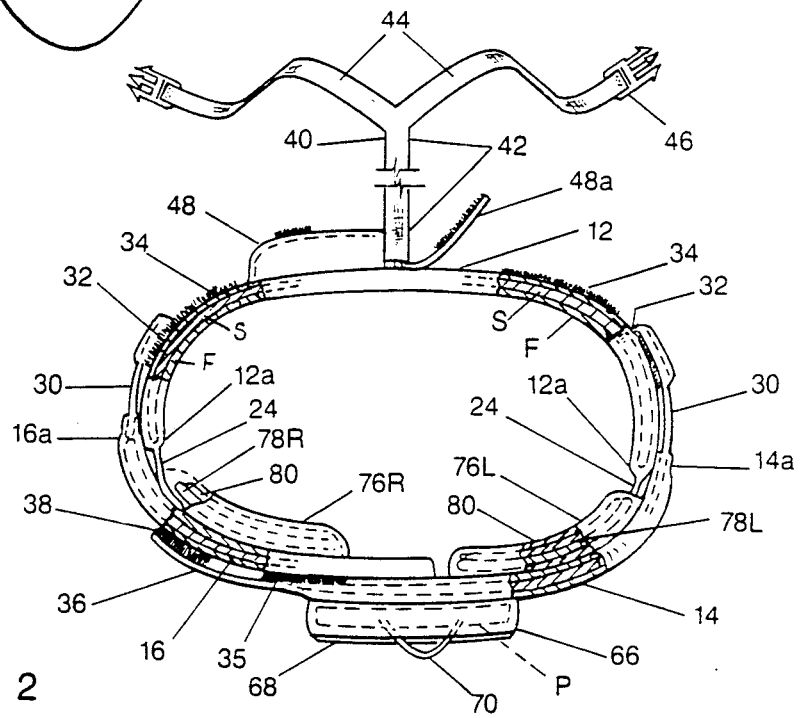
FIG. 2

MULTI-MISSION BALLISTIC RESISTANT JACKET

GOVERNMENT INTEREST STATEMENT

The invention described herein may be manufactured and used by or for the U.S. Government for governmental purposes without the payment of any royalties therefor or thereon. This application and patent may be assigned outright to the U.S. Government.

BACKGROUND OF THE INVENTION

The present invention relates generally to bulletproof garments and more specifically to an improved ballistic resistant soft body type armored jacket that is characterized by being multi-mission adaptable by its unique fit-adjustable structure and various quick attachable-detachable accessories. The unique arrangement of my various jacket-forming components and its use of non-hydroscopic, fire-resistant and water resistant materials together with the unique flotation accessary features uniquely qualify it for various military and civilian missions, and more particularly for Navy, Marine, and Coast Guard personnel whose duties include sea borne special warfare rapid response missions.

PRIOR ART

Heretofore various forms of armored vests and jackets have been devised including some of the so-called soft body armor types which frequently embody the normally very effective ballistic proof or resistant Kevlar® material, manufactured by DuPont Company of Wilmington, Del. Kevlar® and other ballistic resistant materials have been encased in outer covering fabric material known and well-accepted in industry by the name Nylon-Pac which is essentially a rip stop type of Nylon fabric.

While these prior art materials have proven very effective for many land based missions and are well recognized by many as industry standard materials, there are certain substantive shortcomings thereof when subjected to sea water, more particularly to petroleum contaminated waters, and to fire and other high temperature environments. It has been determined that Kevlar® materials are hydroscopic and thus when immersed in water tend to lose a portion of their ballistic resistance property. The outer covering Nylon-Pac became unacceptable for Navy and other shipboard use when subjected to fire due to its propensity for creating a hazardous drip when melting. Thus my present improved jacket embodies newly developed materials which overcome these shortcomings. Also none of the prior art jackets of which I am aware combine all of the novel features provided in my improved jacket.

OBJECTS AND BRIEF SUMMARY OF THE INVENTION

It is a primary object of the present invention to provide a multi-mission adaptable ballistic-resistant jacket embodying a soft body armor which is readily fit-adjustable and of relatively lightweight character.

It is a further object to provide such a jacket fabricated of non-hydroscopic relatively soft body but ballistic-resistant material encased in a fire-retardent and generally water-repellant-treated fabric and one which is quite impervious to most petroleum based fluids.

Another object is to provide a jacket of the aforesaid character which can be donned and its various adjustability features managed by one arm and hand.

The foregoing and other objectives and advantages are achieved by providing the three main body panels, a back panel and a left and right combined front and side panels comprising fabric-encased ballistic resistant non-hydroscopic inserts, attached together in over-the-shoulder portions and an adjoining permanent short collar. The respective left and right front-side panels are flexibly adjoined in an adjustable overlapping manner at both sides and in the front. The jacket extends a maximum of three inches below the waist. It is provided with permanent but flexibly attached first shoulder pad means and readily attachable-detachable secondary shoulder and upper arm pad means, both being of the same ballistic resistant material. Hook and loop type fasteners are used to effect the overlap adjustment and closure of the respective jacket panels. The same type of fasteners are provided on adjoining portions of the primary and secondary shoulder portions, and on flap closures of the inverted chest area pocket and on inward under the arm pockets adapted to receive flotation packets or inserts Similar pockets are provided for an external chest area, on upper and lower back areas for additional optionally usable accessories for different types of mission uses. My new jacket advantageously embodies various forms of a newly developed ballistic proof and ballistic resistant material marketed under the trademarks Spectra®, Spectra Shield® and Spectra 1000®, developed and manufactured by Allied Signal Incorporated of Morristown, N.J. The ballistic resistant inserts are encased in fabric known as Nomex®, to provide an outer covering of highly fire resistant fabric, manufactured and distributed by DuPont Company of Wilmington, Del.

The foregoing and other objects and advantages will become more apparent from the following more detailed description, considered in conjunction with the following illustrative drawing figures.

BRIEF DESCRIPTION OF DRAWING FIGURES

FIG. 1 is a front elevational view of my improved ballistics armor jacket;

FIG. 2 is a horizontal view partially in cross-section and partially in plan view, as viewed approximately on line 2—2 of FIG. 1;

FIG. 6 is an enlarged vertical cross-sectional detail view showing the detachable mode of the auxiliary collar;

DETAILED DESCRIPTION OF PREFERRED EMBODIMENT

Figures 3, 7:
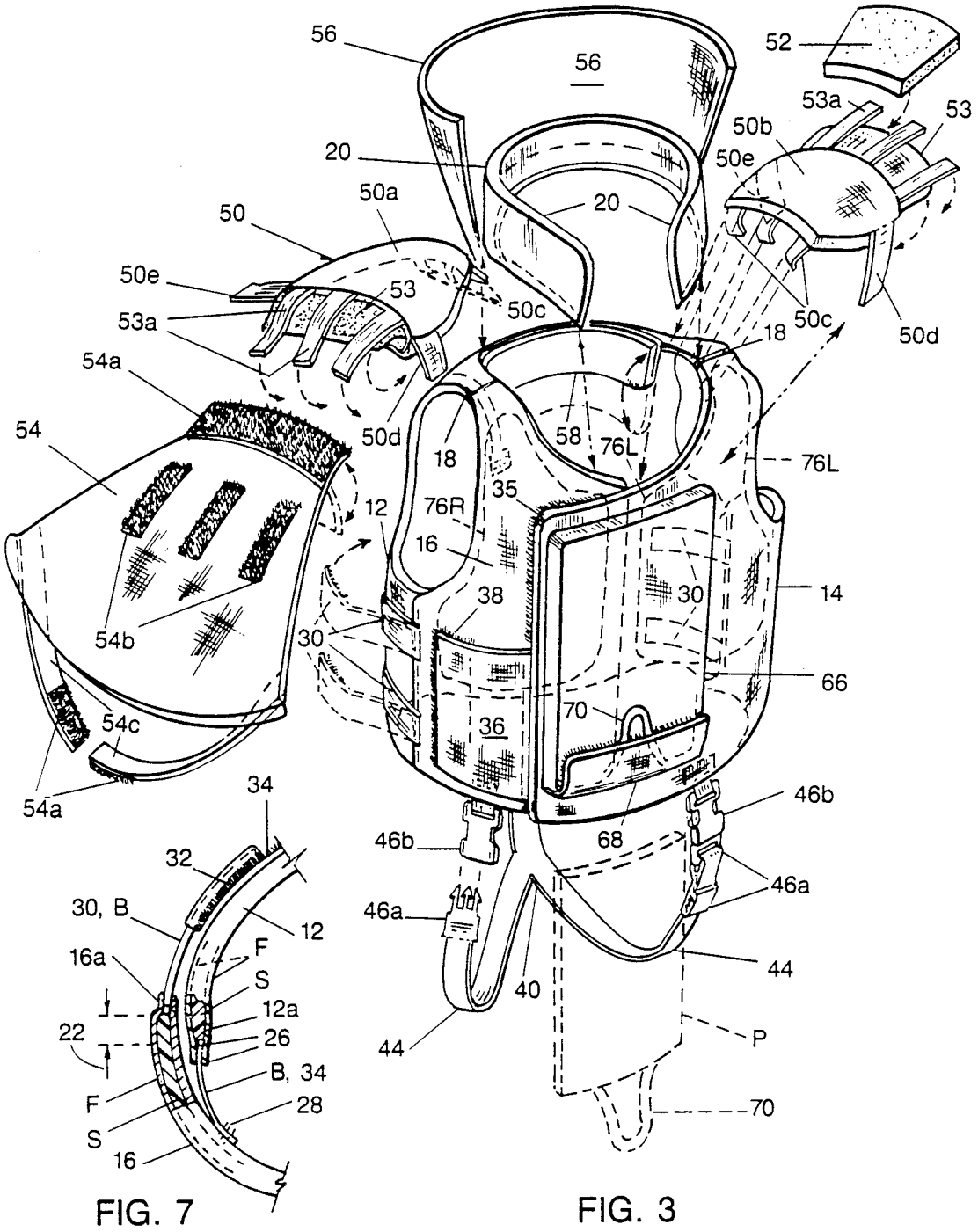
FIG. 3 is a partially exploded perspective view of my improved jacket, better showing some of the basic and some of the auxiliary attachments.
FIG. 7 is a fragmentary horizontal detail view shown partly in cross-section better depicting the flexible overlap of the front and side jacket shell components.

Referring to the accompanying drawing figures, my improved jacket is generally denoted 10 and comprises three main body panel members, a back panel 12, a left combined front and side panel 14, and a right combined front and side panel 16, all of which embody fabric-enclosed, non-hydroscopic form of ballistic resistant inserts, hereinafter referred to as ballistic inserts, or inserts S. A preferred form of these inserts is Spectra Shield®, a product made and distributed by Allied Signal Incorporated of Morristown, N.J. The various inserts are generally designated S, better seen in detail FIGS. 6 and 7. A preferred outer covering fabric F used to encase the ballistic inserts, is a suitable highly durable, high-temperature or substantially fire resistance type of fabric, such as one of the family of Nomex® fibers, manufactured and distributed by DuPont Incorporated of Wilmington, Del. The three main body panels 12, 14, and 16 are flexibly interconnected, at the upper portions by a joinder of over-the-shoulder portions, as by seams 18, FIG. 3. This is in conjunction with a fourth permanent body panel, which constitutes first collar means 20, that is sewn for permanent attachment to a back neck area and respective inward shoulder portions, adjacent seams 18, 18. Body panels 12, 14, and 16 are sized and shaped to define the customary arm-receiving openings when assembled and further interconnect at the side areas. This is achieved by flexible band means B, FIG. 3,7, in a manner to provide and maintain a predetermined amount of overlap, usually a minimum of one inch of the respective ballistic inserts, as denoted at 22, FIG. 7. Band means B preferably includes a like pair of spaced horizontal flexible band members 24 for both inside area connections, only one of each side pair of such bands 24 being visible in FIGS. 2 and 7. Each band member, which has a limited amount of stretchability, is stitched at one of its ends to the respective terminal side edge portions 12*a* of the back body panel 12, as between the adjoining edges 26 of the outer covering fabric F. The other end portion of each band 24 is stitched as at 28, FIG. 7, to the inner fabric covering of the closely overlapped side portion of each of the left and right front panels 14, 16. This is at areas sufficiently inwardly of their terminal side edges to provide the preferred overlap 22, FIG. 7. The band means B further include similar pairs of stretchable flexible bands 30, FIGS. 3, 5 and 7, similarly stitched at one end to the respective terminal side edge portions 14*a* and 16*a*, of panels 14 and 16, FIGS. 2 and 7. The other ends of webs or bands 30 terminate in ends provided with one complementary fastener part 32 of the two part hook and loop type fastener means, such as Velcro®. Velcro fastening means is used to effect selective adjustable fastening of these side portions to the back panel 12, via the other complemental cooperative fastener means 34 thereof, FIGS. 2,7. This mating or complemental fastener means 34 is preferably a strip disposed in an elongated circumferentially extended manner, preferably substantially completely around the full back panel 12, so as effect closure not only for a reasonably degree of girth or torso fit adjustability, up to about two inches, but also to provide an area onto which optional accessories or accessory holding pockets can be attached via the same type of complementary fastener means.

The size of the body-forming panels is such as to normally provide a substantial overlap of the front panels, but not less than one inch of the ballistic inserts. Velcro® fastening means 35 is used to effect the waist-to-neck securing of these overlapped panels. The outermost one of the front overlapping panels, 14, is provided with a stitched-on, generally square flexible extension attachment flap 36 also provided with a substantial area of the mutually cooperable hook and loop Velcro® type fastener means 38. This extension flap 36 provides a secondary flap-locking feature. It is not necessarily of the fully-ballistic-resistant type, and also provides a form of handle to better facilitate part of the wraparound overlapping closure of the front panels. The wearer can use the inside area of his arm to quickly press the Velcro elements together during donning of the garment.

The jacket is of a length preferably to extend a maximum of approximately three inches below the waist so as not to impede the ability of the wearer to bend. For certain mission uses it is necessary that the jacket be secure to avoid distracting shifting or riding up causing interference with the wearer. In the event a wearer has to abandon ship and has incorporated the flotation accessory features, it is mandatory that the jacket be secured by leg strap means to be described hereinafter, to assure the wearer is maintained in a floating survival posture, to be further describe hereinafter.

The leg strap means generally includes a flexible Y-shape strap 40, having back-panel-attached base strap portion 42 adapted to pass through the wearer's crotch, and two branch straps 44,44. Straps 44 terminate in fastener members 46*a*, per FIG. 2 and 3, which are adaptable to mate with complementary fastener members 46*b*, FIG. 3, attached to inner lower portion of front panels 14 and 16. Additionally, the leg strap means embodies a storage pocket 48 having a closure flap 48*a*, in which pocket the strap 40 is advantageously stored in an unobtrusive manner.

Figure 4:
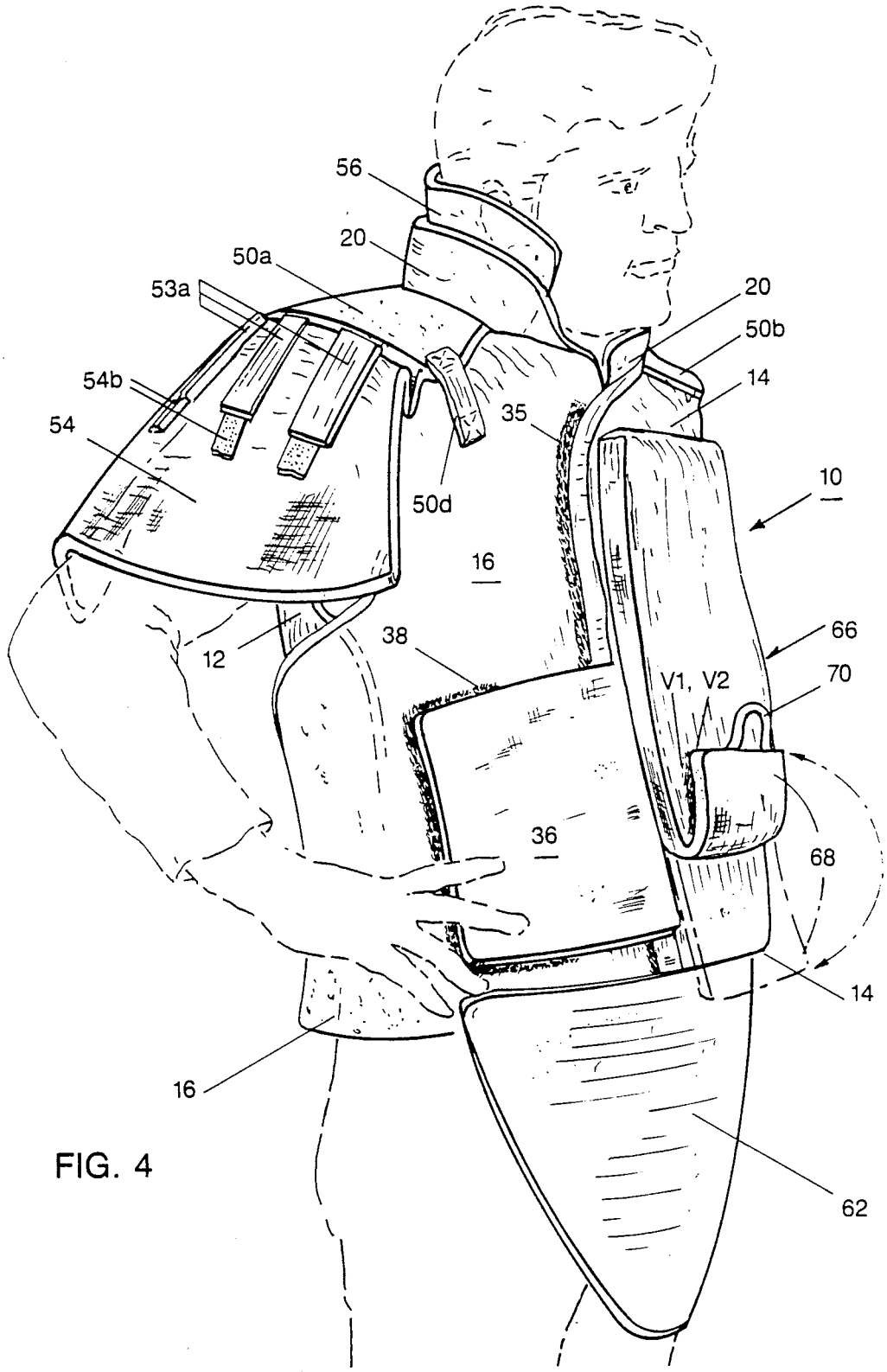
FIG. 4 is a frontal perspective view of my jacket showing features of both FIGS. 1 and 3 as depicted on a wearer of the jacket.

The basic jacket 10 further comprises first shoulder pad means 50 characterized by the same fabric-enclosed ballistic resistant materials, and which includes a pair of generally trapezoidal-shape , or truncated triangular shape pocketed shoulder pads 50*a* and 50*b*. The pocket portions accommodate correspondingly shaped flotation pads 52, FIGS. 1 and 3, of which their generally friction fit retention therein is further assured by Velcroed flap closures 53. Flap closures 53 also have a plurality of preferably three flexible elongated strip tabs 53*a*, FIGS. 3 and 4, provided with one of the Velcro® fastening components which can be wrapped further around closure flap 53 when in the closed condition, unassociated with the optional secondary shoulder pads 54,54 to be described.

The same Velcro® type fastener means is used not only to close the pocket but also to effect attachment to the outer end face of a shoulder-proximal flap portion of a second pair of auxiliary shoulder pads 54, 54 constituting part of second shoulder pad means, to be described hereinafter.

The first shoulder pads 50*a* and 50*b* are permanently stitched to the garment adjacent the collar by one or more flexible tabs 50*c*. Although three narrow tabs are shown, a single wider flap can be used. The pads overlay the shoulder juncture seams 18,18 and are further flexibly attached distally of the collar 20 by the flexible, preferably slightly elastic pair of fore and aft tabs 50*d*,50*e*. Although these tabs are shown stitched to fore and aft portions of the jacket, the same Velcro® type fastener means could be used.

The briefly mentioned second shoulder pad means 54 is one of several accessory items which add uniqueness and increased wearer protection. Other readily attachable-detachable accessories to be described will include a second protective collar means, groin pad means, ammunition pouches or other accessory items, an auxiliary armor plate in an exterior front chest pocket, various flotation pads and heat and cooling pads for insertion in inner pockets and an optional external upper middle back flotation insert pocket.

Figures 5, 8:
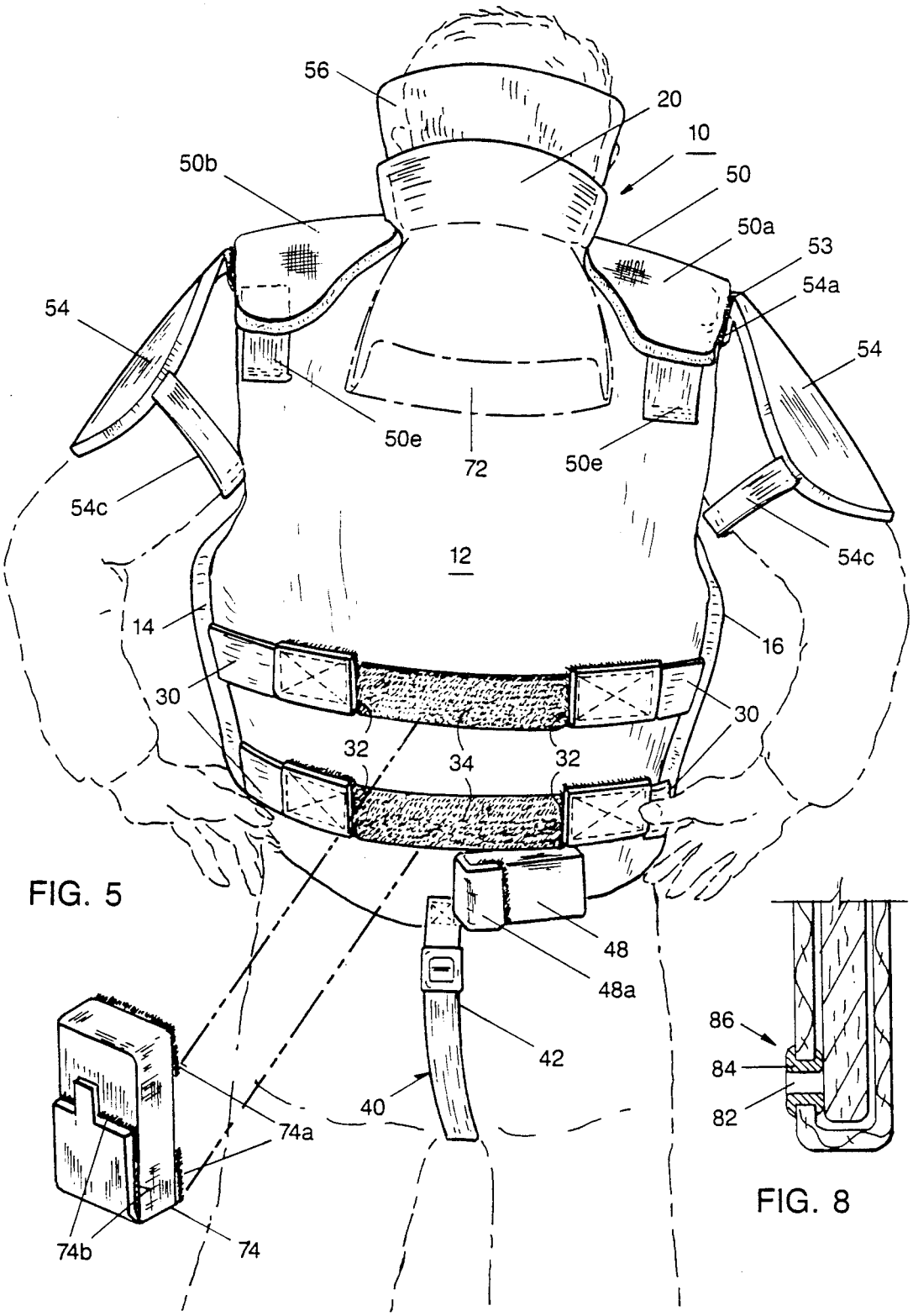
FIG. 5 is a rear elevational view of the jacket and wearer in FIG. 4.
FIG. 8 is a fragmentary detail view of drain hole means provided in each panel and pocket of the jacket.

Continuing with the description for the second shoulder pad means 54, 54, better seen in FIGS. 3–5, these are also characterized by the same fabric-enclosed ballistic-resistant materials. They are of larger size than the first pads, being of sufficiently large, generally truncated, fan shape to cover the outer vertical areas of the wearer's shoulder and upper arms. A shoulder-proximal end portion is covered on its upper surface with a band of Velcro® material as at 54*a*, and is complementary to the Velcro component on the outer surface of flap 53 of each of first shoulder pads 50*a*, 50*b*.

The Velcroed flap 54*a* is adapted to be folded down and mated to the complementally Velcroed flap 53 aforesaid. Pads 54 are further provided with an affixed matching plurality of Velcroed strips 54*b*, FIG. 3, positioned on the upper surface so as to complementally mate with the aforesaid Velcroed flexible strip tabs 53*a* which are affixed to the flap cover 53 of the aforedescribed first shoulder pad means 50.

Additionally, a pair of under arm securing straps 54*c*, with Velcroed end portions 54*d*, are secured to lateral edges of the distal or lowermost portion of each pad 54. The Velcro® fasteners provide an easy manner of attachment and in a manner which partially conforms the pads 54 to the wearer's upper arms.

The next accessory item to be described is the second or auxiliary collar means 56, which is also of the same fabric-enclosed ballistic-resistant Spectra® panel type. It is primarily a taller or higher version of the basic first collar means 20. Although shown displaced in FIG. 3 behind the permanently attached first collar means, it is adapted to be removably attached by Velcro® means V1 and V2 inwardly of the first collar 20, as clearly shown in FIGS. 4, 5, and 6. Second collar 56 includes an attaching band 56*a* stitched to its lower edge at 56*b*. Band 56*a* is provided on its opposite faces with the different panels of the complementary Velcro® components V1,V2. As better seen in FIG. 6, these are adaptable to mate with correspondingly complementary V1,V2 panels which are suitably attached on opposite inside faces of a foldable flap member 58, the inward half panel 58*a* being suitably attached as by stitching 59 to the inside upper neck area of back body panel 12. When the secondary collar is not needed, the folded attachment panel 58 is maintained in its closed condition by the complimentary mating of Velcro panels V1,V2. When it is desired to attach the second collar to the jacket, the flap member 58 is pulled open, as shown by the arrow 60 in FIG. 6, the second collar 56 is positioned inwardly adjacent the first collar 20, so that attachment band 56*a* of the second collar will overlay and become interjoined with the Velcroed inward half flap 58*a*. Thereafter the outer half flap 58*b* is folded back upon the attachment band 56*a* which band 56*a* then becomes lockingly sandwiched therein to hold the second collar 56 in place.

Proceeding to the next accessory, there is a groin pad 62 which also is of the same fabric-enclosed, ballistic-resistant character, FIGS. 1 and 4. As illustrated, groin pad 62 is of inverted generally triangular shape with a downwardly oriented rounded apex portion. The base portion is permanently provided with a plurality of relatively short attachment straps 63 of adjustable character. Straps 63 terminate in fastener members 64 adapted to mate with complementary fastener members 65, FIG. 1, which are preferably stitched via tabs in a known manner to the inside waist areas of the respective left and right front body panels 14 and 16.

It is desirable to provide this jacket with a plurality of various size and shape accessory accommodating pockets, some of which are externally disposed and some of which are disposed internally or on inward portions of the jacket body panels. The principal pocket is the armor-plate-accommodating large pocket 66, which is of relatively rectangular shape, FIGS. 1, 3, and 4. Pocket 66 is preferably formed of the same Nomex® type fabric used in the rest of the jacket, and is permanently attached, as by stitching not shown, in an inverted manner so that its closure flap 68 can be more readily accessed by the wearer. Flap 68 and the adjacent portion of the pocket fabric are provided with the complemental Velcro type fastener components V1,V2. While pocket 66 is initially contemplated to house an auxiliary ballistic-resistant armor plate P, shown in phantom outline in a removed position in FIG. 3, it is understood that it may be used for alternative accessory purposes. The auxiliary armor plate P, whether of steel, ceramic, or other suitable material, is provided with an attached looped pull cord 70 on at least one end thereof. Pull cord 70 is of sufficient length to provide ample exposure of the loop portion when armor plate P is held in repose within the pocket 66. This unique arrangement enables the wearer to quickly pull open the flap 68, responsive to a downward pull of the loop end of the pull cord 70, and to thereby quickly expel the rather heavy auxiliary plate P for any desired reason if or when his mission activity no longer warrants its retention.

Another similar inverted external pocket, which may be of optional character for some embodiments, is shown in broken outline at 72 in FIG. 5. Pocket 72 is primarily adapted to hold one of the flotation units which comprise part of the flotation accessory group to be further described. Alternatively, either a permanent or removable upright pocket, or a Velcro® type mounting patch of large area, none of which is illustrated, may be included in lieu of inverted pocket 72. It is contemplated that the alternative upright pocket or mounting means would be tailored to accommodate a particular accessory item, such as radio equipment or other back pack type accessories.

Smaller size accessory pockets, such as the pocket or pouch 74 shown in FIG. 5, are contemplated to be provided with Velcro® type attachment means 74*a*, or flap closure means 74*b*. Attachment means 74*a* are spaced to correspondingly engage with the aforedescribed complemental Velcro® strip 34. It is quite apparent that other areas of the jacket may be provide with similar Velcro® patches or other auxiliary fastening means to accommodate other mission-oriented accessories.

Proceeding to the inwardly disposed pockets, reference is again made to drawing FIGS. 1, 2, and 3. The inner portions of both front-side panels 14,16 are provided in their respective front and side areas with the irregular shaped pockets 76L and 76R, designed to extend partially beneath a wearer's arms. These pockets are preferably accessed from the bottom and are provided with bottom connected closure flaps, not shown, like that provided for front chest pocket 66. Pockets 76L, 76R are adapted to selectively receive correspondingly shaped flotation insert pads, 78L and 78R respectively, shown fragmentarily and only in broken away portions in FIG. 2.

The cumulative use of flotation pad accessories, when inserted into the various respective aforedescribed pockets, i.e. in the first shoulder pad means, in the optional upper back pocket, and in the newly described inside pockets 76L and 76R, will provide a wearer with the additional buoyancy, beyond that of the inherent buoyancy of the fabric-encased ballistic panels S, in the event of necessity to become water-bound. If a wearer is forced overboard while wearing one of these jackets, and has been wearing the heavy auxiliary chest area armor plate, if desired he can readily jettison the plate in the manner previously described by a quick downward pull on the looped pull cord 70. In lieu of armor plate P, a further auxiliary flotation pad, not shown, may be placed to good advantage in the pocket 66, although even without the latter, the jacket is capable of supporting about 300 pounds.

Yet further contemplated accessories include some of the heat-generating and cool or cold-generating chemical packets. Examplary representations of such packets are denoted at 80 in FIG. 2. There are only generally schematically represented therein, shown coexisting therein with the flotation insert pads 78L, 78R. These heat or cold generating packets are preferably disposed closest to the wearer so that either warmth or coolness may be better conducted to the wearer and its benefits derived generally via an osmosis process of the lungs.

Reference has been made occasionally to the use of the jacket under conditions wherein the wearer may very well find himself immersed in or subjected to a water environment. Although previous mention has been made of preferable use of a water-repellant fabric for this jacket, it is apparent that if the jacket were to become immersed in the sea or river water, the variously described pockets certainly would be subject to water penetration and accumulation. Accordingly, reference is made to the fragmentary illustration in FIG. 8 for one practical exemplary form of providing for drainage of such water. This FIG. 8 is a fragmentary cross-sectional view taken through a lower pocket portion of the jacket. The pocket formed of Nomex® fabric F, may house either some of the ballistic-resistant insert Spectra® material S, or an auxiliary armor plate P, or any of the other described accessory items. Any suitable type of drain hole means 82 is to be incorporated, and as shown it may be comprised of a suitable durable grommet-like component 84 having an appropriate drainage passageway 86 to allow accumulated water to drain out. The number and size of the holes, preferably at least one for each pocket and/or panel, is such as to assure drainage without the necessity to remove the jacket.

Accordingly, from the foregoing detailed description, it is apparent that a novel much improved anti-ballistic or ballistic-resistant jacket package has been devised, providing many new advantages. One of the many advantages is the flexibility and adjustability of the body panels which contribute significantly to providing improved ease of wearer movements for most all of the widely used tactical firing positions. The overlap features at the sides and in the front provide areas of double thickness protection to some of these most vulnerable areas. The relatively lightweight soft body armor jacket is inherently buoyant, fire-resistant, and impervious to salt water and most petroleum based fluids. The buoyancy material pad inserts can be removed or added as the mission environment may dictate. When in place they inherently further provide potential protection against trauma injury.

In addition to the natural buoyancy and non-hydroscopic character of the fabric-encased Spectra-Shield® ballistic panel material, the use of various flotation material pockets and the hold down leg straps contribute to the wearer's ease of mind in the event he has to abandon ship into the sea. The leg straps keep the jacket well balanced, preclude undue shifting or riding up and imparting any sensation of choking or otherwise interfering with his breathing. The flotation inserts and stated buoyant character of the jacket will float him with his head face up above the water regardless of his state of consciousness. The leg straps, when not needed, are detachable and stowable in the central back pocket out of the way to avoid restriction of the wearer's other duties. The downward opening of the pockets from a lowermost edge and the ease of Velcro® type fasteners impart quickens accessibility as necessary. All of the Velcro® type fasteners materials are of the fire-retardant type. Velcro is the registered trademark for a form of the hook and loop type fasteners. Velcro® is owned by Velcro U.S.A. Incorporated, with offices in Manchester, N.H. and Norcross, Ga.

The improved jacket has been subjected to successful rigorous testing which proved its highly fire-resistant protective character and a determination that it would not contribute to any increased potential for burn injury. Its bullet resistant 50 ply Spectra-Shield® character was maintained even after 29 days of continuous soaking and immersion in mixtures of artificial sea water, and after 12 days in a diesel fuel contaminated solution. Following the aforesaid immersions, the tested jacket was placed in its wet condition only 16.5 feet from the muzzle of a test gun barrel to produce zero degree obliquity impacts using calibers 9 mm, 15.0 grain, red tipped TZZ ammunition. At feet per second speeds of from 1537 to 1660, with maximum velocities of from 1668 to 1694 feet per second, after multiple various shots to the front, back, groin, and shoulder areas, there were no penetrations and no appreciable deformation.

The overall protection level of the jacket is considered to be IIIA as specified by the National Institute of Justice. With the chest area auxiliary armor plate in place, that area was found to be capable of withstanding multiple strikes from an AK47 firing 7.62×39 mm steel pin rounds.

The aforedescribed jacket has been described in detail relative to its currently known best mode. It is apparent that other variations or modifications might be made without departing from the spirit and scope of the invention as defined in the appended claims.

What is claimed is:

1. A ballistic resistant garment of the vest or jacket type which is of a length to cover the lower waist and back areas of a wearer of the garment, said garment comprising in combination:

a. interjoined fabric-encased ballistic-resistant jacket-forming panels including a back body panel having partial left and right side portions, left and right combined front and side body panels, all of which are shaped to collectively define a pair of arm-receiving holes, and so that the front portions overlap significantly;

b. said body panels being permanently interjoined at over-the-shoulder portions with each other and with a first collar means including a fabric-enclosed ballistic-resistant first collar panel;

c. said jacket-forming body panels being of predetermined size and shape, and including flexible band means interconnected between the respective side portions to provide and maintain a predetermined amount of side overlap at all times;

d. mutually cooperable releasable fastener means on the respective back, side, and front body panels to provide for fit-adjustment and a closed overlapping relationship of all panels;

a. said body and collar panels being made of non-hydroscopic, inherently buoyant, ballistic-resistant material, such as Spectra Shield ®, and encased in substantially fire-resistant or high-temperature resistant fabric, such as Nomex ®, thereby imparting a natural buoyancy and repellancy to the garment when subjected to a petroleum-contaminated water environment;

f. the garment, further comprising first shoulder pad means in the form of generally trapezoidal shaped ballistic resistant left and right fabric-covered shoulder pads respectively having collar-proximal attachment means for fixedly but flexibly attaching them at a juncture of said collar with said over-the-shoulder strap portions in a manner which amply straddles said latter portions;

g. said shoulder pads respectively also having distal fore-and-aft disposed flexible attachment bands for flexibly attaching fore and aft portions of said respective pads to the respective front and back body panels adjacent the shoulder areas but distally of said collar; and h. said garment including pockets in both the shoulder pads, and in at least inside areas of said body panels to selectively removably receive therein respective flotation pads which inherently also serve as potential trauma reducing means when so worn.

2. The garment of claim 1, further including second ballistic-resistant shoulder pad means including left and right fabric-covered preshaped shoulder pads having opposed proximal and distal edge portions;

said first and second shoulder pad means respectively having cooperative attachable-detachable fastener means on the distal portions of said respective first shoulder pads and on the respective proximal portions of said second shoulder pads, thereby providing selective removable attachment with one another.

3. The garment of claim 2, wherein said pads of said second shoulder pad means include selectively fastenable strap means adapted to engage beneath a wearer's upper arms to maintain optimum effective use thereof under combat conditions.

4. The garment of claim 1, wherein said pockets include closure flaps, and said pockets and flaps respectively have releasable hook and loop fastener means.

5. The garment of claim 1, further including a chest area pocket disposed in an inverted manner and facing outwardly on said garment, and having a removable separate ballistic proof armor plate sized to slidably fit within said chest area pocket, said armor plate having flexible pull cord means secured to one end of the plate, said pull cord means including a looped cord or ribbon of a length sufficient to remain exposed exteriorly of said chest area pocket when reposed in said pocket with its pocket closure flap closed, said exposed cord loop adaptable to be finger pulled in a downward direction to facilitate quick opening of the pocket and quick discharge or removal of the armor plate in the event of an emergency need for its removal, as when subjected to abandoning ship into the sea.

6. The garment of claim 1, wherein one of said combined front and side body panels which is considered to be the outermost panel when they are in an overlapping closed condition on a wearer, is provided with an integral extension panel or flap portion which is adapted to further overlay and fasten to the opposite inner panel to a greater circumferential extent, and said inner and outer body panels and said extension panel respectively having mutually cooperable hook and loop type detachable fastener means strategically positioned so as to provide for selectively adjustable fit around and upon the wearer.

7. The garment of claim 1, wherein said back body panel terminates in partial side wrapping areas respectively having terminal edges to which at least one generally horizontal strong, slightly stretchable, flexible fabric-like band is fixedly attached at a proximal end of the band, and having the respective distal ends of said bands fixedly attached to inside inward waist areas of the respective side waist portions of the respective combined front and side body panels, such that the ballistic proof portions of said body panels are maintained in an overlapping manner; and each of said left and right combined front and side body panels also terminating in side edges respectively having at least one generally horizontal strong slightly stretchable, flexible fabric-like band fixedly attached thereto at a proximal end of the band, and the band having respective distal free end portions provided with fastener means to cooperate with complementary fastener means provided on said back body panel across a circumferential area thereof of sufficient extent to facilitate the moderate degree of size and fit adjustability of the garment.

8. The garment of claim 1, further comprising second collar means including an auxiliary detachable high protective collar of the same ballistic resistant material, said auxiliary collar also being fabric enclosed and of substantially greater height than said first-mentioned collar; said auxiliary collar at a lowermost edge portion and said back body panel at an upper edge adjacent the first-mentioned collar, each having mutually cooperable fastener means to provide for selective removable attachment of said auxiliary collar in superposed inward relation to said first-mentioned collar.

9. The garment of claim 1, further including an exteriorly disposed inverted flap-coverable pocket on a frontal chest area of said garment, and an auxiliary ballistic-resistant armor plate with an attached flexible looped pull cord, sized to fit within said inverted pocket with the loop exposed to facilitate quick-opening of the pocket flap and quick removal of said auxiliary armor plate responsive to downward pull on said pull cord.

10. The garment of claim 1, further comprising flexible leg strap means including a Y-shaped strap with the base end attached to a lower medial area of said garment's back body panel and adapted to extend through a wearer's crotch area, and having the separate branch strap portions of the Y terminating in fastener means, said strap portions adapted to embrace the wearer's upper leg portions;

said garment further including complemental strap fastener means disposed on inner portions of said left and right body panels to cooperate with and provide for releasable fastening of said leg strap means; and a flap covered pocket fixedly attached to a lower medial area of said garment's back body panel and adapted to receive and retain said leg strap means therein in a non-interferring manner when not needed.

11. The garment of claim 1, further comprising a selectively attachable-detachable ballistic resistant groin pad, with cooperative fastener means on an upper edge thereof to cooperate with correspondingly positioned fastener means also provided on said garment.

12. The garment of claim 11, wherein said groin pad is of generally inverted triangular shape with the apex being rounded and of sufficient width to protect a wearer's groin and upper frontal leg areas; and the cooperative fastener means for selectively attaching said groin pad to the garment include quick-release type complemental fasteners.

13. The garment of claim 1, wherein said body panels and pockets are provided with drain hole means to facilitate discharge of any acquired water or liquid when and if immersed in such liquid.

14. The garment of claim 1, further including a flap-closable pocket on the upper middle back body panel member disposed adjacently below said collar, said pocket adaptable to receive supplemental insert pad means selected from a group including a flotation insert, an auxiliary missile proof armor plate insert, and heat and cold generating insert pads.

15. The garment of claim 1, further including removable low profile auxiliary heat-generating and body-cooling pad inserts shaped and sized to fit within at least some of the respectively shaped pockets provided in said garment.

16. A multi-mission-capable ballistic resistant garment and attachments therefor comprising in combination a. a jacket type garment which embodies multiple ballistic resistant jacket-forming body components including relatively movable and overlapping back and left and right combined front and side body panels, said body panels sized and shaped to provide a pair of arm holes, a moderate overlap in the side areas and substantial overlap in the frontal area, utilizing flexible and limited stretchable fastener bands and quick attach-detach fastener means to facilitate and effect moderate size and fit adjustability and closure of said garment;

b. said garment having multiple pocket means whereby said body panels each have at least one integrally formed pocket to accommodate selective accessory items therein;

c. a ballistic resistant first collar means integrally attached to said jacket, and readily attachable-detachable auxiliary ballistic resistant second collar means of substantially greater height than and having means for removably attaching it adjacently inwardly of said first collar means;

d. first shoulder pad means comprising fabric enclosed pads of the same ballistic resistant material fixedly attached adjacent said first collar means, and having flexible attaching means distally of said first collar means for flexibly attaching distal portions of said shoulder pads to said garment;

e. selectively attachable-detachable groin pads means; and f. each of said body forming components and attachments therefor having drain hole means provided therein to facilitate quick draining of water therefrom if immersed in water, without need to remove the garment from the wearer.

17. The garment of claim 16, further including leg strap means and a related unitarily attached, closable pocket means medially attached in the waist area to the back body panel;

said leg strap means including a flexible Y-shaped strap of which the two arms of the Y are adapted to overlay each of the wearer's legs after extending up from the wearer's crotch area, and which two arms terminate in fastener means adapted to cooperate with complementary fastener means provided on a lower portion of said garment.

18. The garment of claim 16, further including second shoulder pad means including left and right enlarged preshaped shoulder pads to provide extended shoulder and upper arm protection; and said first and second sets of shoulder pads having mutually cooperable hook and loop fasteners means to facilitate their quick attachment and detachment as a mission need may dictate.

19. The garment of claim 16, wherein said pocket means include pockets both interiorly and exteriorly of said garment, at least some of said pockets having closure flaps with hook and loop type fastener means, said pockets including an inverted front exterior chest area pocket adaptable to receive a ballistic resistant armor plate;

an interior pocket on each left and right combined front and side body panel sized so as to overlay a substantial portion of a wearer's lung and rib cage area, and extending below the arm holes;

pockets in said shoulder pad means, and multiple insert pad means including relatively flat pads corresponding in shape generally to the shape of each of said pockets and being composed of respectively different materials selectable from a group including i. buoyant flotation material, ii. auxiliary ballistic resistant material, iii. heat-generating compositions, and iv. cool-cold-generating compositions.

20. A ballistic resistant garment of the vest or jacket type which is of a length to cover the lower waist and back areas of a wearer of the garment, said garment comprising in combination:

a. interjoined fabric-encased ballistic-resistant jacket-forming panels including a back body panel having partial left and right side portions, left and right combined front and side body panels, all of which are shaped to collectively define a pair of arm-receiving holes, and so that the front portions overlap significantly;

b. said body panels being permanently interjoined at over-the-shoulder portions with each other and with a first collar means including a fabric-enclosed ballistic-resistant first collar panel;

c. said jacket-forming body panels being of predetermined size and shape, and including flexible band means interconnected between the respective side portions to provide and maintain a predetermined amount of side overlap at all times;

d. mutually cooperable releasable fastener means on the respective back, side, and front body panels to provide for fit-adjustment and a closed overlapping relationship of all panels;

e. said garment including body pocket means comprising at least one exteriorly disposed inverted flap-coverable pocket on an outermost front body portion in at least the general chest area, said pocket and coverable flap having quick release complemental fastening means for closing the inverted pocket;

f. insert means for selective removable association with and retention in said inverted flap-coverable pocket selected from a group including supplemental flotation pad means, auxiliary heat-and-cold generating packet means, and separate ballistic proof armor plate means including an armor plate having a flexible pull cord means secured thereto which cord means includes a looped cord of a length sufficient to remain exposed exteriorly of said pocket when said separate armor plate is pocket enclosed and retained by said flap, said exposed cord loop adapted to be hand pulled in a downward direction to facilitate quick opening of the pocket and quick removal of the armor plate when circumstances warrant; and g. said body panels being made of non-hydroscopic, inherently buoyant, ballistic-resistant material, such as Spectra Shield®, and encased in substantially fire-resistant or high-temperature resistant fabric, such as Nomex®, thereby imparting a natural buoyancy and repellancy to the garment when subjected to a petroleum-contaminated water environment.

21. The garment of claim 20, further comprising second collar means including an auxiliary detachable high protective collar of the same ballistic resistant material, said auxiliary collar also being fabric enclosed and of substantially greater height than said first-mentioned collar panel; said auxiliary collar at a lowermost edge portion and said back body panel at an upper edge adjacent the first-mentioned collar, each having mutually cooperable fastener means to provide for selective removable attachment of said auxiliary collar in superposed inward relation to said first-mentioned collar panel.

22. The garment of claim 20, further comprising first shoulder pad means in the form of generally trapezoidal shaped ballistic resistant left and right fabric-covered shoulder pads respectively having collar-proximal attachment means for fixedly but flexibly attaching them at a juncture of said collar with said over-the-shoulder strap portions in a manner which amply straddles said latter portions;

said shoulder pads respectively also having distal fore-and-aft disposed flexible attachment bands for flexibly attaching fore and aft portions of said respective pads to the respective front and back body panels adjacent the shoulder areas but distally of said collar; and said garment including pockets in both the shoulder pads, and in inside areas of said body panels to selectively removably receive therein respective flotation pads which inherently also serve as potential trauma reducing means when so worn.

23. The garment of claim 22, further including second ballistic-resistant shoulder pad means including left and right fabric-covered preshaped shoulder pads having opposed proximal and distal edge portions;

said first and second shoulder pad means respectively having cooperative attachable-detachable fastener means on the distal portions of said respective first shoulder pads and on the respective proximal portions of said second shoulder pads, thereby providing selective removable attachment with one another.

24. The garment of claim 20, wherein said body pocket means includes a plurality of inner and outer pockets of predetermined shape, and further including removable low profile auxiliary heat-generating and body-cooling pad inserts shaped and sized to fit within at least some of the respectively shaped inner pockets provided in said garment.

25. The garment of claim 20, further including a plurality of auxiliary accessory items for selective removable attachment to said garment via cooperative fastener means provided respectively on said garment and on said respective accessory items, said accessory items being selectable from a group including a. flexible leg strap means including a Y-shaped strap with the base end attachable to a lower medial area of said garment's back body panel and adapted to extend through a wearer's crotch area, and having the separate branch strap portions of the Y terminating in fastener means, said strap portions adapted to embrace the wearer's upper leg portions;

b. a selectively attachable-detachable ballistic resistant groin pad, with cooperative fastener means on an upper edge thereof to cooperate with correspondingly positioned fastener means also provided on said garment; and c. at least one flap-closable auxiliary pocket adaptable to receive supplemental accessory items including insert pad means selected from a group including a flotation insert, an auxiliary missile proof armor plate insert, and heat and cold generating insert pads.

26. A ballistic resistant protective garment of the vest or jacket type comprising in combination:

a. interjoined fabric-encased, ballistic-resistant, jacket-forming body panels embodying back, left and right front and side body portions, all of which are shaped and joined to collectively define the jacket and a pair of arm-receiving holes;

b. said garment further including body pocket means comprising at least one exteriorly disposed inverted flap-coverable pocket on an outermost front body portion in at least the general chest area, said pocket and coverable flap having quick release complemental fastening means for closing the inverted pocket; and c. insert means for selective removable association with and retention in said inverted flap-coverable pocket selected from a group including supplemental flotation pad means, auxiliary heat and auxiliary cold generating packet means, and separate ballistic proof armor plate means including an armor plate having a flexible pull cord means secured thereto, and which cord means includes a looped cord of a length sufficient to remain exposed exteriorly of said pocket when said separate armor plate is pocket-enclosed and retained by said flap, said exposed cord loop adapted to be hand pulled in a downward direction to facilitate quick opening of the pocket and quick removal of the armor plate when circumstances warrant.

* * * * *